United States Patent [19]

Peters

[11] Patent Number: 4,473,776

[45] Date of Patent: Sep. 25, 1984

[54] DISCONNECT MEANS FOR CAPACITOR BALLAST INCANDESCENT LAMP

[75] Inventor: Philip H. Peters, Greenwich, N.Y.

[73] Assignee: General Electric Company, Schenectady, N.Y.

[21] Appl. No.: 387,724

[22] Filed: Jun. 11, 1982

[51] Int. Cl.[3] ..... H01J 7/44; H01R 33/30

[52] U.S. Cl. ..... 315/74; 315/71; 315/119; 200/51.09; 200/51.14

[58] Field of Search ..... 315/74, 71, 119, 362, 315/72; 313/315, 318; 307/326; 362/802; 328/7; 200/51.09, 158, 51.14

[56] References Cited

U.S. PATENT DOCUMENTS 3,895,195 7/1975 Morrison et al. ..... 200/51.09

FOREIGN PATENT DOCUMENTS 155238 2/1922 United Kingdom .
185410 3/1923 United Kingdom .
263776 7/1927 United Kingdom .
265139 7/1927 United Kingdom .
630922 10/1949 United Kingdom .
637408 5/1950 United Kingdom .
2099241A 12/1982 United Kingdom .

*Primary Examiner*—David K. Moore
*Assistant Examiner*—Vincent DeLuca
*Attorney, Agent, or Firm*—Mark L. Mollon; James C. Davis, Jr.; Marvin Snyder

[57] ABSTRACT

An incandescent lamp possessing a ballast circuit comprising a resistor and capacitor in parallel further includes means for interrupting the connection between the ballast and external contacts provided on the base of the lamp. This interruption occurs upon removal of the lamp from its matching socket to prevent the occurrence of capacitor voltage across the external lamp contacts. The circuit is again closed upon reinsertion of the lamp in the matching socket to permit normal lamp operation.

7 Claims, 3 Drawing Figures

DISCONNECT MEANS FOR CAPACITOR BALLAST INCANDESCENT LAMP

BACKGROUND OF THE INVENTION

The present invention relates to capacitor ballasts for incandescent lamps and, more particularly, to means for removing the resistor capacitor combination from the circuit in such a manner so as to prevent capacitor voltage from appearing across external lamp contacts.

With certain incandescent lamps, in particular low voltage incandescent lamps, it is preferred that a series capacitor be used as a ballast to drop the line voltage to the lamp. Such ballast capacitors are connected in series with the lamp filament. Such lamps are preferably assembled with a standard incandescent configuration with the ballast capacitor mounted externally to the evacuated lamp envelope. Such lamps usually employ a conventional screw-in Edison base for insertion into a matching socket. While the present invention is not limited to such Edison base socket designs, the background and essential features of the present invention may best be understood through contemplation of such a lamp configuration. In particular, a low voltage incandescent lamp ballasted in this way would preferably have one side of the ballast capacitor connected to the center external base contact, with the other side of the capacitor being connected in series with the lamp filament. The other side of the filament would be connected to the outer, screw-shaped external electrical contact. This does not preclude a reversed connection, however, in which one side of the ballast capacitor is connected to the outer, rather than central, external contact. However, each such lamp design offers a disadvantage in that the ballast capacitor may remain charged at a relatively high voltage. Furthermore, upon removal of the lamp from the socket, the ballast capacitor voltage may appear across the external lamp contacts. This is an undesirable condition.

In order to rapidly dissipate the voltage across the ballast capacitor, it is possible to dispose a shunt resistor across the capacitor to dissipate any charge present on the capacitor. Since it would be desirable to remove the capacitor's charge as quickly as possible, it would be necessary to employ a resistor having a relatively low resistance value to decrease the dissipative time constant. However, such a low value of resistance would dissipate substantial heat and reduce the ballast efficiency unless the resistor is disconnected whenever the lamp is operating. However, it appears difficult to disconnect the resistor just as the lamp is inserted into a socket. If such a mechanism were not to work properly, a large current flow could result, even though momentarily, and thus destructive overheating of the incandescent lamp filament could occur. Accordingly, a more reliable and simpler solution to this problem is desired.

SUMMARY OF THE INVENTION

In accordance with a preferred embodiment of the present invention, a ballast for a low voltage incandescent lamp comprises a resistor and capacitor pair connected in parallel together with means for interruptably connecting the resistor and capacitor from a series circuit including the lamp filament and external lamp contacts, the disconnection being effected by removal of the lamp from a matching socket. In accordance with one preferred embodiment of the present invention, the means for disconnection includes a grommet having a conductive post disposed through it so that upon removal of the lamp from the socket the grommet returns to an undeformed shape so as to remove the post from electrical contact with the resistor capacitor pair. Furthermore, additional means may be provided to assist in restoring the grommet to its undeformed shape. Another embodiment of the present invention comprises the above-mentioned ballast in series combination with a conventional incandescent lamp filament disposed in an evacuated, light-transmissive envelope.

Accordingly, it is an object of the present invention to provide a ballast for a low voltage incandescent lamp.

It is an additional object of the present invention to provide a capacitively ballasted incandescent lamp which is removable at any time from its socket without having the ballast capacitor voltage appear across the external lamp contacts.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
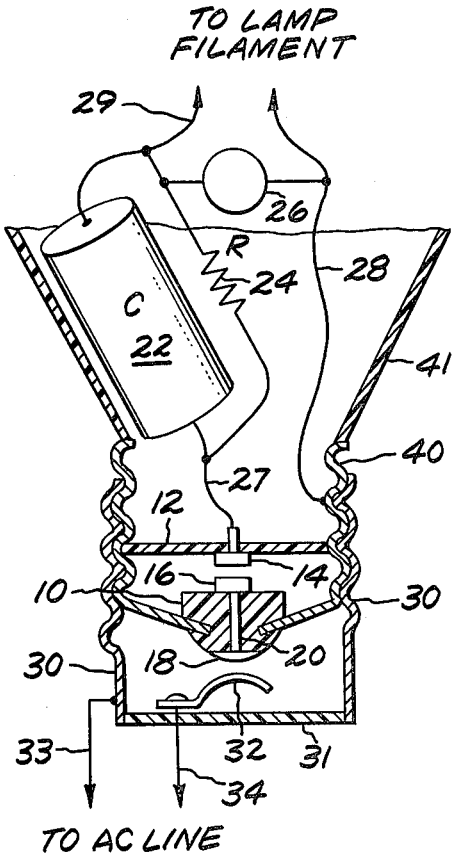
FIG. 1 is a partial cross-sectional side elevation view illustrating a lamp in accordance with the present invention.

FIG. 1 illustrates a lamp in accordance with the present invention. Enclosed within ballast housing 41 is ballast capacitor 22 having capacitance C. Across ballast capacitor 22 there is connected resistor 24 having resistance R. Together, the product RC defines a dissipative discharge time constant. The resistor and capacitor pair, 22 and 24, is connected in series with lamp filament 44 (in FIG. 3) by means of lead 29. The other side of lamp filament 4 is connected by means of conductive electrical lead 28 to conductive external lamp base contact 40 which preferably comprises a conventional screw-in Edison base design. The other side of the resistor and capacitor pair, 22 and 24, is connected by means of lead 27 to conductive contacts disposed on fixed insulating separator 12. In normal lamp operation, contact 14 is in electrical connection with contact 16 which is connected through conductive post 20 to external lamp center contact 18. Post 20 is disposed through flexible grommet 10. The lamp illustrated in FIG. 1 is shown partially removed from its socket, so that grommet 10 as shown is in its undeformed state. Grommet 10 is held in position in an aperture in metal base 40 and serves to insulate base 40 from external contact 18. Metal base 40, together with contact 18, form the external electrical connections for the lamp and ballast. It is across these metal contacts that the presence of ballast capacitor voltage is undesirable and which is prevented by the operation of the present invention.

FIG. 1 further shows the lamp of the present invention disposed, in a partially-inserted position, in a conventional Edison base socket. This socket generally comprises a conductive outer portion 30 which is normally in electrical contact with lamp base 40 during operation of the lamp. The conventional socket illustrated also comprises an insulating socket base member 31 to which center post contact 32 is affixed for ultimate contact with external lamp contact 18. Leads 33 and 34 connect the outer socket portion 30 and the center post socket contact 32, respectively, to an alternating current line voltage. However, it should be noted that the socket itself forms no part of the present invention. Furthermore, while the present invention is described with respect to a conventional Edison-base socket, the present invention is not so limited, but is instead applicable to any lamp base design in which a deforming force may be exerted and maintained upon insertion of the lamp into a socket. Furthermore, it is equally possible to connect lead 28 to contact 14 and lead 27 to lamp base external outer contact 40.

During normal operation, the lamp is fully inserted into the socket, in which case, contact 32 presses against external lamp contact 18 thereby deforming grommet 10 so that contact 16 is moved into an abutting relationship with contact 14 thereby closing an electrical circuit. Accordingly, in the present invention, it is desirable that the lamp be fully inserted into the socket to insure proper operation.

If the lamp is removed from the socket, even with the power on, the deforming force inserted on grommet 10 by contact 32 is thereby removed, thus returning grommet 10 to its undeformed position in which contacts 16 and 14 are separated. Thus, removing the lamp from the socket disconnects capacitor 22 in such a way that any voltage present across capacitor 22 existing at the time of lamp removal is not permitted to be present in any way across external lamp contacts 18 and 40.

Grommet 10 preferably comprises a high temperature insulating elastomeric material, such as a silicone. The metal portions of the lamp (other than the filament, of course) preferably comprise a good conducting material such as copper. However, other materials such as aluminum or brass may also be employed where appropriate. The ballast also preferably includes an overvoltage protective device 26 such as a voltage clamp comprising a metal oxide varistor which is connected in parallel with the lamp filament. Thus, during overvoltage conditions, clamp 26 operates to shunt current from capacitor 22 away from filament 44. In this way, the ballast circuit protects the lamp filament from receiving large surges in applied voltage, particularly if the capacitor has not been fully discharged prior to relighting of the lamp. The resistance R of resistor 24 is made high so that it dissipates little power during normal lamp operation. For example, for a ballast capacitor 22 having a capacitance C of 50 microfarads a resistance R of 0.1 megohms is effective to fully discharge the capacitor in about 5 time constants or 25 seconds. At a frequency of 60 Hz, the power lost in resistor 24 during normal lamp operation is only approximately 10 milliwatts. This is a completely acceptable value. Thus, resistor 24 operates to remove all charge from capacitor 22 for safe storage of the lamp. Furthermore, this is accomplished with minimal loss in overall lamp efficiency due to $I^2R$ losses in resistor 24.

Figure 2:
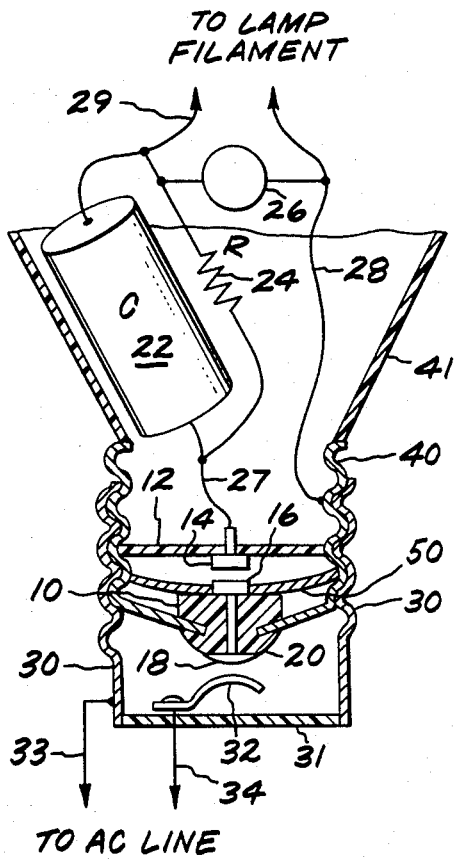
FIG. 2 is a partial cross-sectional side elevation view of a lamp similar to FIG. 1 but showing additional mechanical bias means for disconnection.

Furthermore, contacts 14 and 16 may also comprise bistable spring material to minimize sparking when the contacts are opened or closed. FIG. 2 illustrates the presence of additional mechanical bias means 50 operating to insure the separation of contacts 14 and 16 during removal of the lamp from the socket.

Figure 3:
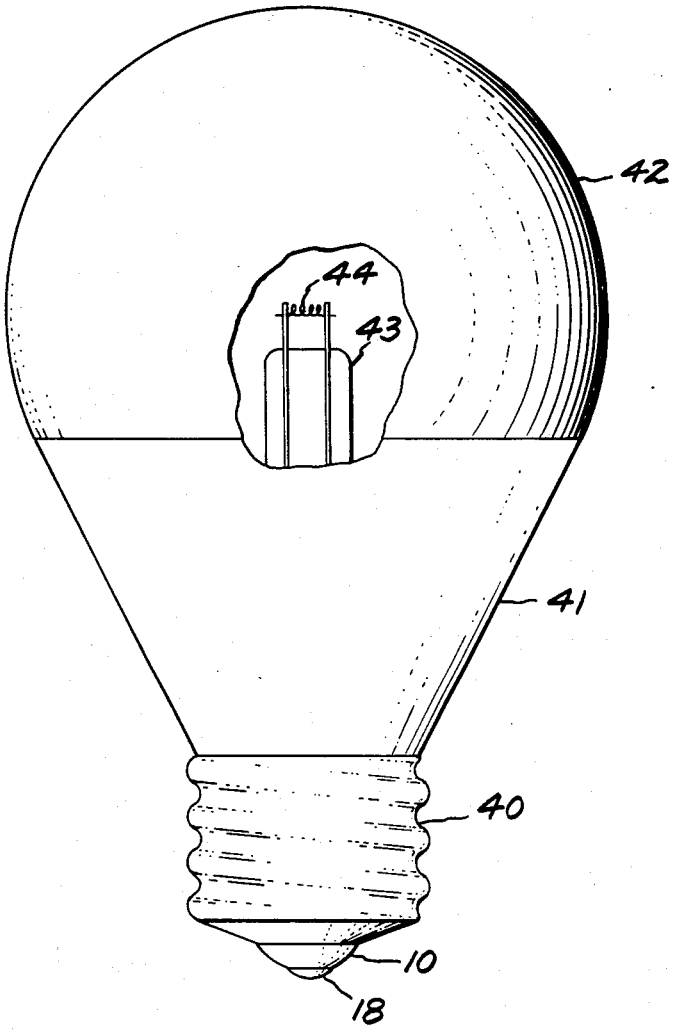
FIG. 3 is a side elevation view of a lamp employing the ballast and disconnect means of the present invention.

FIG. 3 illustrates a lamp of the present invention in which the ballast contained in housing 41 is assembled together with an evacuated light-transmissive envelope 42 in which incandescent filament 44 is disposed. In accordance with well-known lamp design, envelope 42 may also include an inert gas. In any event, herein, and in the appended claims, such internal envelope conditions are summarized by the statement that the envelope contains an "inert atmosphere", even in the case that the atmosphere is a partial vacuum. Filament 44 is supported by wire leads extending from glass support 43. Additionally, envelope 42 may have disposed on the inner surface thereof an infrared reflecting coating. Such a coating provides for more efficient electrical heating of filament 44.

From the above, it may be appreciated that the present invention provides a reliable means not only for capacitively ballasting incandescent lamps, particularly low voltage lamps, but also for providing a reliable means for disconnecting the capacitive element or elements of this ballast from the external lamp contacts. In this way, even after immediate removal of the lamp from its mating socket, the lamp may be handled and shipped safely without problems associated with the appearance of capacitive voltages across these contacts. Furthermore, it is seen that the ballast of the present invention operates to protect the filament itself from overvoltage conditions.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A ballast for a filamented incandescent lamp having external electrical contacts which engage electrical power supply contacts upon insertion of said lamp into a socket, said ballast comprising:

a resistor and capacitor pair connected in parallel;

means for connecting a first side of said parallel-connected resistor capacitor pair to a first side of the filament of said incandescent lamp to thereby form a series circuit therewith;

means for connecting the second side of said filament to one of said external contacts; and means for interruptably connecting a second side of said resistor and capacitor pair to a second of said external contacts, said interruption being occasioned by removal of said lamp from said socket.

2. The ballast of claim 1 further including a voltage clamp device connected in parallel with said filament.

3. The ballast of claim 1 in which said external lamp contacts comprise an Edison base.

4. The ballast of claim 1 in which said interruptable connecting means includes a gromet having a conductive post disposed therethrough so that upon removal of said lamp from said socket, said gromet thereby returns to an undeformed shape so as to disengage said post from the series electrical circuit including said filament.

5. The ballast of claim 4 further including additional bias means assisting in said disengagement upon removal of said lamp from said socket.

6. A lamp comprising:

the ballast of claim 1 disposed in a housing having external contacts disposed thereon for connection to a power supply through said socket; and light-transmissive envelope having an inert atmosphere and having said filament disposed therein, said envelope being affixed to said ballast housing, whereby an integral lamp assembly results.

7. An incandescent lamp comprising:

an evacuated, light-transmissive envelope having an inert atmosphere therein;

an electrically-heatable filament disposed within said envelope;

a ballast housing supporting said envelope;

a screw-in base at one end of said ballast housing, said base having a pair of external electrical contacts for engaging a source of electrical power upon insertion of said base into a matching socket;

a parallel connected resistor and capacitor pair connected in series with said filament on one side thereof, said pair being disposed within said housing;

means for electrically connecting the other side of said filament to one of said external contacts on said screw-in base; and means for disconnecting the side of said resistor and capacitor pair not connected to said filament, from the other of said external contacts upon removal of said base from said socket.

* * * * *